109-82

1/25/83 XR 4,369,717 SR

United States Patent [19]

Bollier

[11] 4,369,717

[45] Jan. 25, 1983

[54] DISAPPEARING UNDERGROUND SAFE

[75] Inventor: J. F. Bollier, Adliswil, Switzerland

[73] Assignee: Patmark Consultants, Newark, N.J.

[21] Appl. No.: 153,692

[22] Filed: May 27, 1980

[51] Int. Cl.[3] ..... E05G 1/00

[52] U.S. Cl. ..... 109/45; 109/82

[58] Field of Search ..... 109/31, 45, 39, 49, 109/82, 84, 80, 47

[56] References Cited

U.S. PATENT DOCUMENTS

| | | | |
|---|---|---|---|
| 73,375 | 1/1868 | Park | 109/85 |
| 139,792 | 6/1873 | Howard | 109/47 |
| 206,182 | 7/1878 | Koloseus | 109/39 |
| 952,877 | 3/1910 | Coles | 109/82 |
| 993,627 | 5/1911 | Wege | 109/82 |
| 1,124,169 | 1/1915 | Prushey | 109/31 |
| 1,461,963 | 7/1923 | Bieneck | 109/45 |
| 3,408,966 | 11/1968 | Gartner | 109/80 |
| 4,022,137 | 5/1977 | Chiu | 109/47 |

FOREIGN PATENT DOCUMENTS

| | | | |
|---|---|---|---|
| 1465133 | 11/1966 | France | 109/45 |
| 693319 | 6/1953 | United Kingdom | 109/45 |

*Primary Examiner*—Reinaldo P. Machado

*Attorney, Agent, or Firm*—Horst M. Kasper

[57] ABSTRACT

A conventional steel case with drawers or a cash container are placed on an elevating system placed in a container below ground level. An outer shell of the container comprises armored, high strength and water proof concrete and an inner shell of the container comprises galvanized steel plate and the container is covered by a three layer armored cover plate. The cover plate has an upper layer of jointless connected steel segments or of a compact high hardness cast iron plate and prevents drilling and cutting with portable tools. The intermediate layer of copper plate renders impossible the use of cutting burners. A lower layer of an asbestos containing insulating plate protects the contents of the disappearing underground safe from heat in case of fire. Safety switches for the power of the motor and the actuation of the motor and a built in alarm system provide additional protection.

14 Claims, 2 Drawing Figures

DISAPPEARING UNDERGROUND SAFE

BACKGROUND OF THE INVENTION

1. Field of the Invention

This invention relates to a disappearing safe hidden underground for storing valuables and for preventing unauthorized access or access by force.

2. Brief Description of the Background of the Invention Including Prior Art

Conventional built in safes for walls and floors are solidly walled in with masonry and have a small volume and are furthermore inconvenient to operate. Built in safes in walls are limited in their depth by the usual limited thickness of the walls. Furthermore such wall safes can be relatively easily forced open and are only to some extent fire proof because of their small volume. Solidly attaching a large safe to a basement floor results in inconvenient operation and a movable cover can relatively easily be forced open.

SUMMARY OF THE INVENTION

1. Purposes of the Invention

It is an object of the invention to provide an underground safe which can conveniently be operated.

It is a further object of the invention to provide an underground safe which is difficult to open by force.

It is a further object of the invention to provide an underground safe which can have a large volume.

These and other objects and advantages of the present invention will become evident from the description which follows.

2. Brief Description of the Invention

The present invention provides a disappearing safe which comprises an outer shell from reinforced, high hardness and waterproof concrete; an inner shell of a corrosion resistant steel casing attached to the outer shell; a stop at the upper edge of the inner wall an elevating mechanism inside of the inner shell; a steel platform connected to the elevating mechanism and which steel platform can be lifted up or lowered down by the elevating mechanism; a safe positioned on the steel platform and an armoured plate on top of the steel platform and where in the lower position the upper side of the armored plate is flush with the surrounding area and the armored plate is adapted to the contour of the upper edge of the surrounding wall and is secured in position by the stop.

The corrosion resistant steel casing can be made from galvanized steel plate and can consist of one, two, or more parts.

The platform can be attached to a steel frame and rollers can be provided for guiding the motion of the steel frame. The armored plate can comprise several layers and three layers can be a top layer of a segmented hardened steel plate or a cast iron plate with high hardness, the intermediate layer can be a copper plate and the lower plate can be an asbestos containing insulating plate and wherein the stop is a recessed edge at the upper edge of the side wall securing the bottom side of the armored plate.

An alarm system can be provided for preventing unauthorized opening and/or opening by force of the safe. A switch means can be provided for actuating the elevating mechanism and the switch means can comprise a motor, a coded key switch for providing power input of the motor and a remotely controlled actuating switch for the motor.

The elevating mechanism can comprise at least one motor and it can be a hydraulically, pneumatically, electromagnetically or mechanically operated system. A mechanical elevating mechanism can comprise a gear, chain or rope drive. The safe on the platform can be a steel case with drawers.

The invention accordingly consists in the features of construction, combination of elements and arrangement of parts which will be exemplified in the apparatus hereinafter described and of which the scope of application will be indicated in the appended claims.

BRIEF DESCRIPTION OF THE DRAWING

In the accompanying drawing in which is shown one of the various possible embodiments of the invention.

DETAILED DESCRIPTION OF THE PREFERRED EMBODIMENTS

In accordance with the present invention there is provided a safe which is sunk in the basement floor and which comprises a container of rectangular cross-section with an outer shell of armored, high hardness and water proof special concrete and an inner shell of a two part galvanized steel casing. A case with drawers serves as the container for the valuables. The case is positioned on a platform attached to a steel frame and the steel frame motion is guided by rollers. The case can be lifted out of the container by a hydraulic lifting mechanism. The movable inner part of the disappearing safe is protected against fire and break-ins by a three layer armored plate located in the plane of the basement floor. This armored plate comprises a top layer consisting of a segmented high hardness steel plate, an intermediate layer of copper plate and a lower layer of an insulating plate containing asbestos. A safety switch is provided for the power fed to the motor of the hydraulic system for actuating the same and an internal electrical alarm system is provided against unauthorized opening and/or opening by force. The disappearing underground safe of the present invention employs a proven lifting mechanism for containers, furniture, vehicles and the like and combines it with the building of safes. The movable underground safe can provide considerable advantages relating to the operation and security of the safe.

Figure 2:
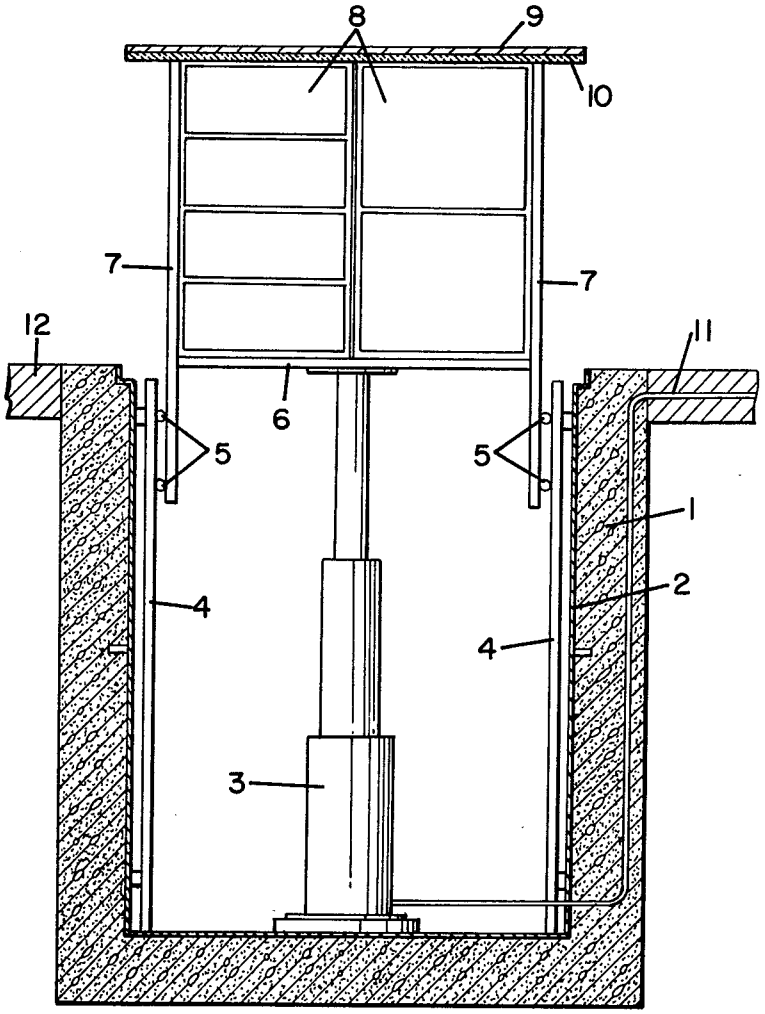
FIG. 2 is a sectional view of the open disappearing underground safe.
Figure 1:
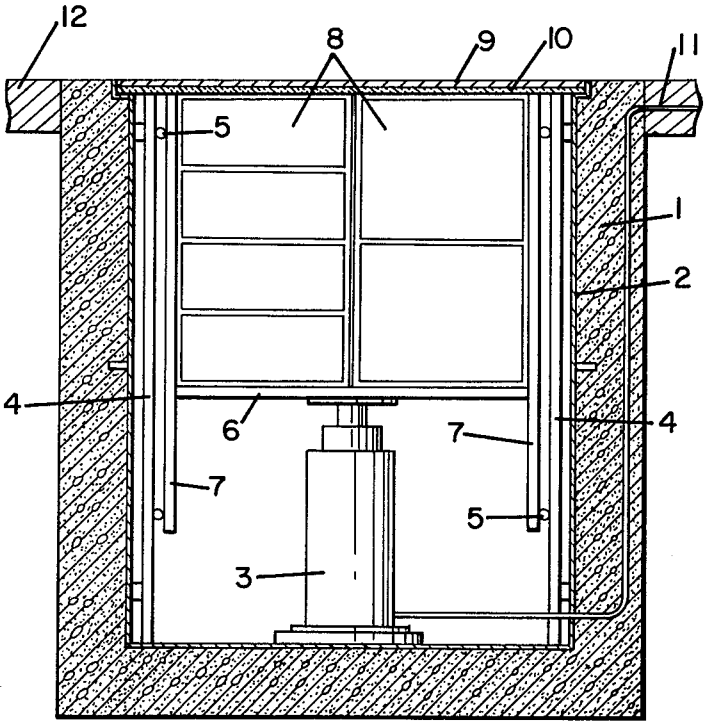
FIG. 1 is an sectional view of the closed disappearing underground safe.

Referring now to FIG. 1 there is shown a cross-section of the safe when closed. The concrete wall 1 of the basement cavity is covered with the two part galvanized steel casing 2. The casing is constructed from two parts, since a one part casing would be in general too large for being transported through usual basement doors. The steelcasing serves as a complete protection against ground water and humidity and as a support for the guiding tubes 4 for the case frame 7. The floor plate of the lift element 3 is solidly anchored in the concrete floor of the container, for example by way of straddling dowels of high tensile strength. The top plate of the lift element 3 is rigidly bolted to the platform 6. When lifting the platform, the roller bearings 5 provide easy and safe guidance for the frame of the safe 8. The safe 8 can be a steel case with drawers and the embodiment shown comprises two parts and corresponds in dimension and construction to a pair of the usual desk bases. The hight and kind of the bases can be combined as desired from a number of drawer types. The armored plate comprising the two layer metal part 9 and the asbestos containing insulating plate 10 fits exactly into the upper collar of the steel plate casing 2 and rests on a sealing edge thereby preventing the entering of moisture and liquids from the top into the interior of the container. The hydraulic fluid line 11 runs from the motor and pump of the hydraulic system through the basement floor 12 and then through the concrete wall of the container to the lift element 3. FIG. 2 shows the same basement floor safe with lifted up drawer section and in ready to operate position.

The disappearing underground safe of the present invention can be employed in company offices as well as in private homes where there is a need for an optimal safe and spaceous storage container for readily available valuables and documents.

What is claimed is:

1. A disappearing safe comprising an outer shell from reinforced, high hardness and waterproof concrete;

an inner shell of a corrosion resistant steel casing attached to the outer shell;

a stop at the upper edge of the inner shell;

an elevating mechanism inside of the inner shell;

a steel platform connected to the elevating mechanism and which steel platform can be lifted up or lowered down by the elevating mechanism where the steel platform is attached to a steel frame with rollers guiding the motion of the steel frame;

a safe positioned on the steel platform; and an armored plate on top of the safe, where in the lowered position of the safe the upper side of the armored plate is flush with the surrounding area and adapted to the contour of the upper edge of the shell and secured in position by the stop whereby if the safe is in the upper position the steel platform is about at the ground level and supported from below by the frame.

2. The disappearing safe as set forth in claim 1 wherein the corrosion resistant steel casing is a galvanized steel plate casing.

3. The disappearing safe as set forth in claim 1 wherein the corrosion resistant steel casing is from two or more parts.

4. The disappearing safe as set forth in claim 1 wherein the armoured plate comprises three layers, the top layer being a segmented hardened steel plate, the intermediate layer being a copper plate and the lower plate being an asbestos containing insulating plate.

5. The disappearing safe as set forth in claim 1 wherein the armored plate has a top layer of cast iron plate with high hardness and wherein the stop is a recessed edge at the upper edge of the side shell securing the bottom side of the armored plate.

6. The disappearing safe as set forth in claim 1 further comprising an alarm system for preventing unauthorized and/or opening by force of the safe.

7. The disappearing safe as set forth in claim 1 further comprising a switch means for actuating the elevating mechanism.

8. The disappearing safe as set forth in claim 7 wherein the switch means comprises a motor;

a coded key switch for providing the power input to the motor; and a remotely controlled actuating switch for the motor.

9. The disappearing safe as set forth in claim 1 wherein the elevating mechanism comprises at least one motor.

10. The disappearing safe as set forth in claim 1 wherein the elevating mechanism is a pneumatically operated elevating mechanism.

11. The disappearing safe as set forth in claim 1 wherein the elevating mechanism is a hydraulically operated elevating mechanism.

12. The disappearing safe as set forth in claim 1 wherein the elevating mechanism is an electromagnetically operated elevating mechanism.

13. The disappearing safe as set forth in claim 1 wherein the elevating mechanism is a mechanically operated elevating mechanism comprising a gear, chain or rope drive.

14. The disappearing safe as set forth in claim 1 wherein the safe is a steel case with drawers.

* * * * *